United States Patent [19]

Lewis et al.

[11] Patent Number: 4,474,374

[45] Date of Patent: Oct. 2, 1984

[54] GAME TABLE WITH ALTERNATE BOARD

[76] Inventors: Dwayne K. Lewis; Annette H. Lewis, both of 2843 Sycamore Way, Santa Clara, Calif. 95051

[21] Appl. No.: 954,913

[22] Filed: Oct. 26, 1978

[51] Int. Cl.[3] ..... A63D 15/00

[52] U.S. Cl. ..... 273/5 R; 273/123 R; 273/126 R

[58] Field of Search ..... 273/126 R, 126 A, 284, 273/108, 113, 118, 123 R, 3 A, 5 A, 5 R, 6, 22, 127 B, 85 P, 85 H, 14, 87.2, 127 B, 4 R, 7, 9, 176 E, 94 R, 88, 11 R, 109, 121 R, 118 R; 108/118, 121, 122, 123, 157

[56] References Cited

U.S. PATENT DOCUMENTS

| | | | |
|---|---|---|---|
| 192,162 | 6/1877 | Gourd | 108/118 |
| 615,476 | 12/1898 | Chapman | 108/118 |
| 1,813,116 | 7/1931 | Clausen | 273/176 E |
| 1,850,420 | 3/1932 | Schuldt | 273/284 |
| 2,001,829 | 5/1935 | Slandidge | 273/109 |
| 2,116,500 | 5/1938 | James | 273/123 R |
| 2,462,526 | 2/1949 | McNair | 273/11 R |
| 2,759,780 | 8/1956 | Baker, Jr. | 108/157 |
| 3,160,121 | 12/1964 | Bedol | 108/118 |
| 3,406,970 | 10/1968 | Webb, Jr. | 273/85 H |
| 4,004,804 | 1/1977 | Gholson | 273/22 |
| 4,063,728 | 12/1977 | Zemanek | 273/9 |

FOREIGN PATENT DOCUMENTS

| | | | |
|---|---|---|---|
| 717464 | 3/1931 | France | 273/3 A |
| 322881 | 8/1957 | France | 273/118 R |
| 252478 | 6/1926 | United Kingdom | 273/121 R |

*Primary Examiner*—Richard C. Pinkham
*Assistant Examiner*—T. Brown
*Attorney, Agent, or Firm*—Jack M. Wiseman

[57] ABSTRACT

A game table for playing Chinese billiards includes a first or basic playing surface provided by a member of square configuration having a Masonite veneer surface thereon. This relatively hard playing surface is bounded on all sides by an upwardly projecting rail, and is provided with suitable holes and with lines and other indicia scribed thereon so that the game can be played using wooden pucks. When the game is being played, the table is supported on a tripod stand. A second playing surface is provided in the form of a removable insert made up of a flat, square sheet of stiff material covered with a felt cloth on which the same indicia is marked. The felt surface makes it possible to play the same game using plastic or hard rubber balls. The insert fits snugly inside the rails of the basic board and is provided with holes that correspond in location to the holes in the basic board.

8 Claims, 10 Drawing Figures

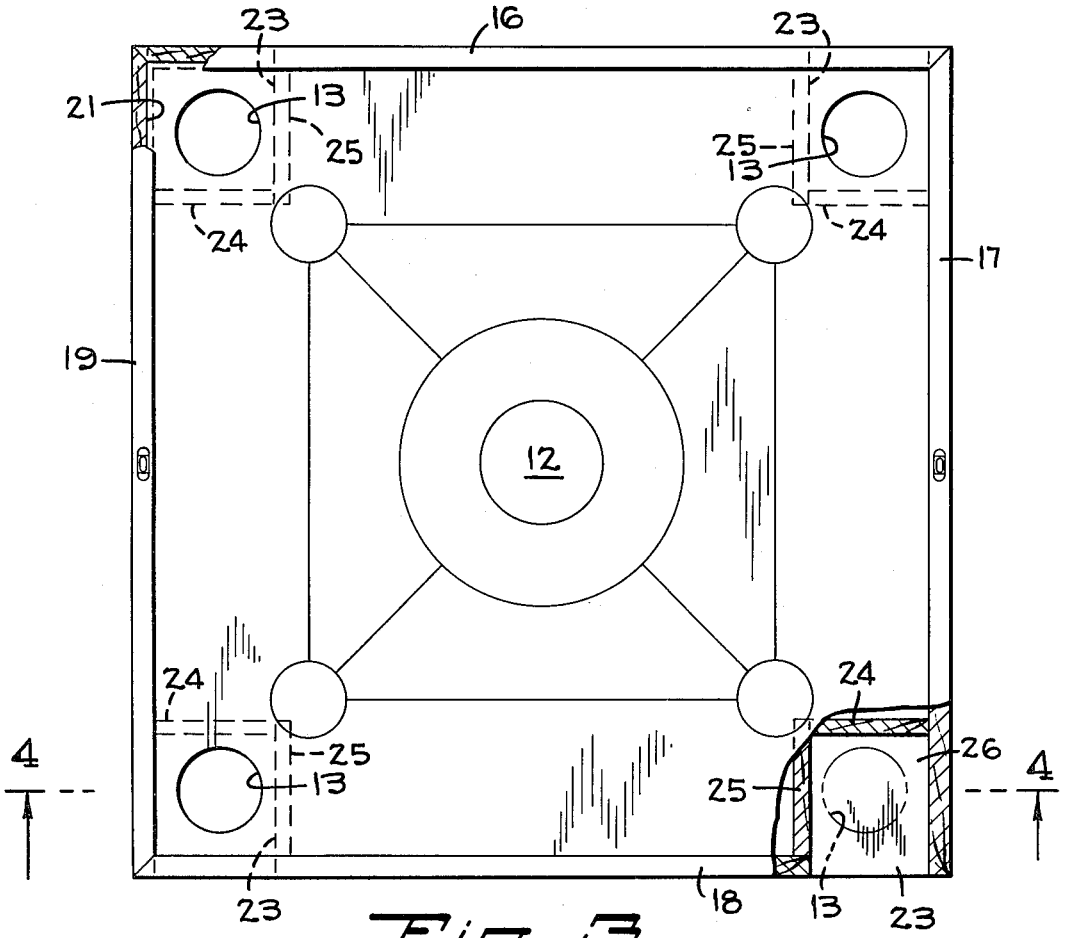
Fig-3
Fig-4
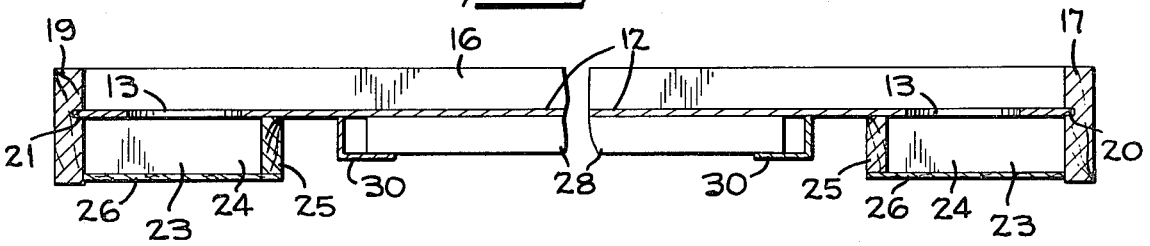
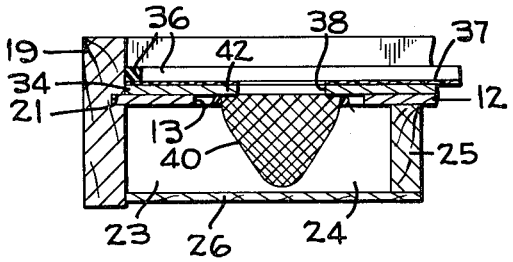
Fig-7

GAME TABLE WITH ALTERNATE BOARD

BACKGROUND OF THE INVENTION

This invention relates to game tables and particularly to tables having changeable playing surfaces.

For various reasons of space or economics it has been recognized that it is advantageous to provide two or more games by employing a basic unit on which one game is played and providing an insert or covering, which can be placed over the playing field of the basic unit and which provides a playing field for a different game. In many of such games the playing medium, such as balls, is the same for both games.

Clausen U.S. Pat. No. 1,813,116 discloses a pool table over which a removable sheet may be positioned to convert the game from a pool game to a pool-table golf game in which the same pool balls are used. Webb U.S. Pat. No. 3,406,970 provides a basic board and several removable liners, all surfaces being adapted for play with a ping pong ball. Gholson U.S. Pat. No. 4,004,804 and Zemanek U.S. Pat. No. 4,063,728 disclose similar game tables.

One of the features of the present invention is the provision of a novel simple tripod support for the game table. The patent to Barker, U.S. Pat. No. 2,759,780, concerns a rather complicated tripod support, and the patent to Johnson, U.S. Pat. No. 1,852,751, discloses an antislip device which is adapted for use with tripods.

SUMMARY OF THE INVENTION

The game table of the present invention includes a main or basic playing board of square configuration and having a relatively hard surface, such as a Masonite veneer, on which suitable indicia are inscribed. This hard surface is particularly suitable for the sliding movement thereover of wooden pucks which are propelled by a typical pool cue and are eventually received in holes formed in the playing board at the four corners thereof. An alternate board or insert, which is completely separate from the main board, comprises a rigid backing board on which a covering of felt is secured. This second board has holes which correspond in location to the holes of the main board so that when the second board is placed over the first board the holes are in registry. The felt is provided with the same indicia as is inscribed on the surface of the main board so that the same game can be played. However, the surface of the felt is particularly adapted for play with plastic or rubber balls. Thus, the game can be changed selectively from one using wooden pucks to one using balls. Since this is a game of skill involving eye-hand coordination, and since the speed of interaction of wooden pucks with each other and with the hard veneer surface is different than the speed of interaction of the balls with each other and with the surface of the felt, the mere selective use of either the veneer or the felt surface adapts the game for persons of various physical abilities and different degrees of coordination and dexterity. It is accordingly an object of the present invention to provide a game board which is arranged to be selectively arranged so that the same game is available for playing by persons of different abilities.

Another object is to provide a simple effect tripod stand for a game table.

BRIEF DESCRIPTION OF THE DRAWINGS

FIG. 3 is a plan of the board of FIG. 1.

FIG. 4 is a section taken along line 4—4 of FIG. 3.

FIG. 7 is a fragmentary section taken at one corner of the game table when the alternate board is in place over the main board.

DESCRIPTION OF THE PREFERRED EMBODIMENT

Figure 1:
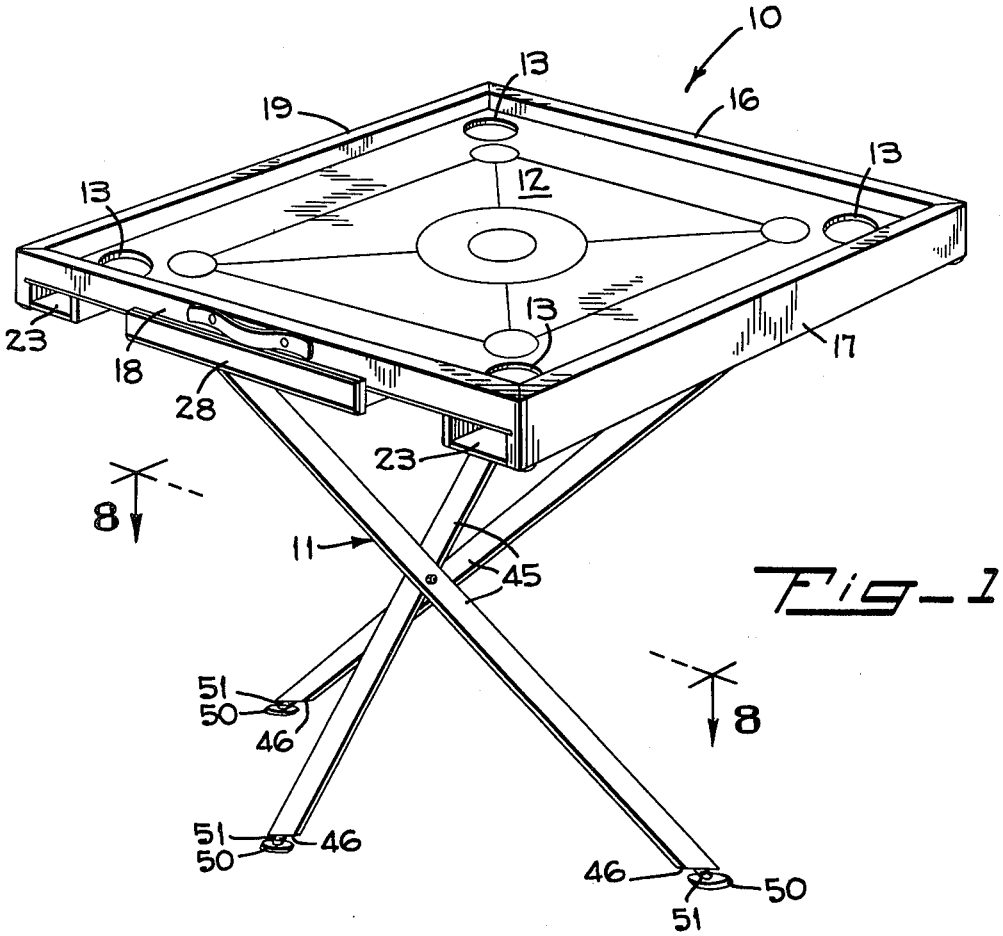
FIG. 1 is a schematic perspective of the basic board of the game table of the present invention.

In FIG. 1 the reference numeral 10 indicates generally the basic unit of the game table supported on a tripod stand 11. The unit comprises a main or basic board 12 of square configuration made of Masonite and having a smooth hard surface in which lines and circles are inscribed and highlighted by paint. Four holes 13 are cut through the board 12 adjacent the four corners. Four side rails 16–19 (FIG. 3) enclose the board 12, each rail having two beveled ends and each end being in abutting contact with a beveled end of an adjacent side rail. Grooves 20 and 21 (FIG. 4) in the side rails 19 and 17, respectively, receive the board 12 and, when the ends of adjacent side rails are secured together, as by nailing, the board is locked in place.

As seen in FIG. 4, the side rails 19 and 17 extend below the board 12 to partially support four puck receptacles 23. Each receptacle is located beneath one of the four holes in the board, one receptacle being shown at one corner of the board in FIG. 3. Each receptacle includes a back wall 24, a side wall 25 and a floor 26, all members being made of wood, such as ash. The back wall 24 and the side wall 25 are bonded to the underside of the board 12, and floor 26 is tacked or glued to the lower surface of the walls. As seen in FIG. 1, the receptacles are open on one side so that pucks that fall through the holes into the receptacles can be removed through this forward opening.

A drawer 28 (FIG. 1) is slidably disposed on ways 30 (FIG. 4) so that pucks and balls can be conveniently stored.

Figure 2:
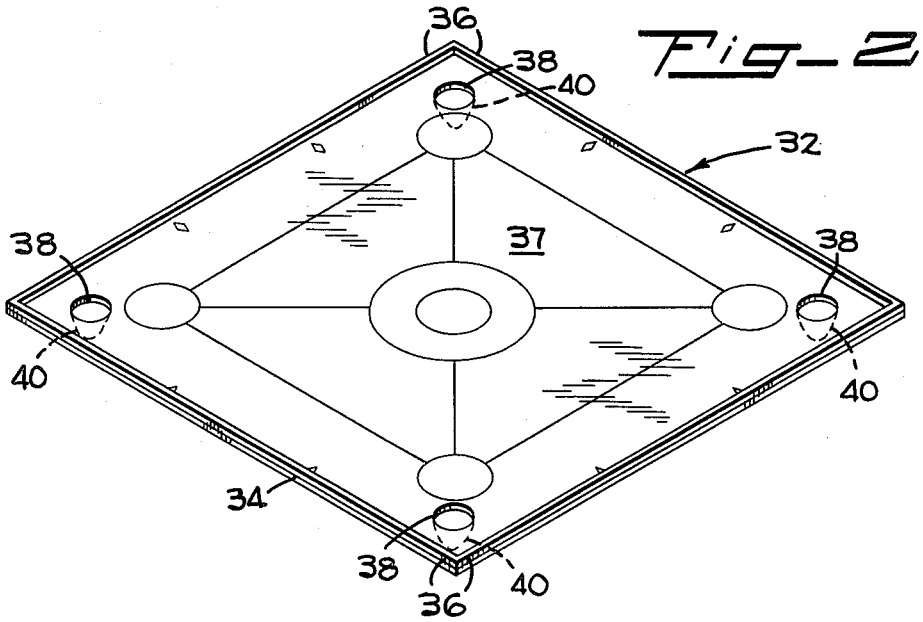
FIG. 2 is a schematic perspective of the supplementary board which is adapted to be placed over the unit of FIG. 1 to effect a change in the playing surface of the game.
Figure 5:
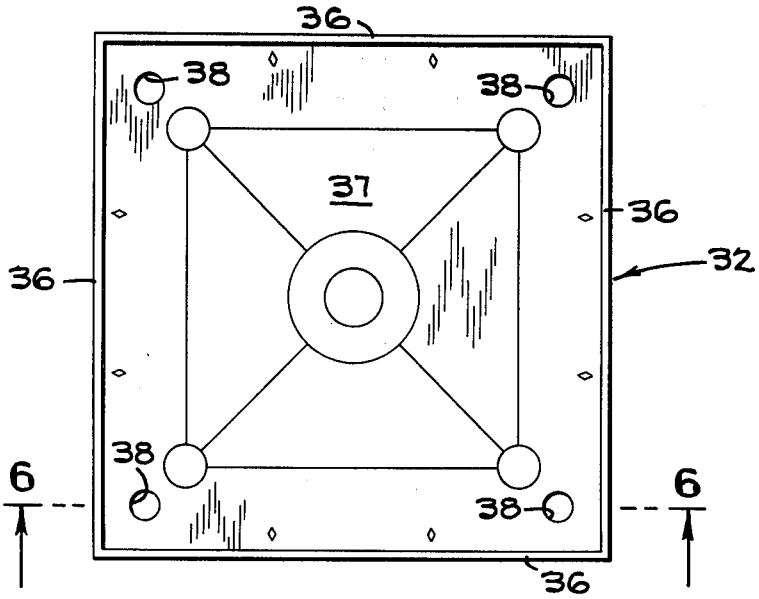
FIG. 5 is a plan of the supplementary game board of FIG. 2.
Figure 6:
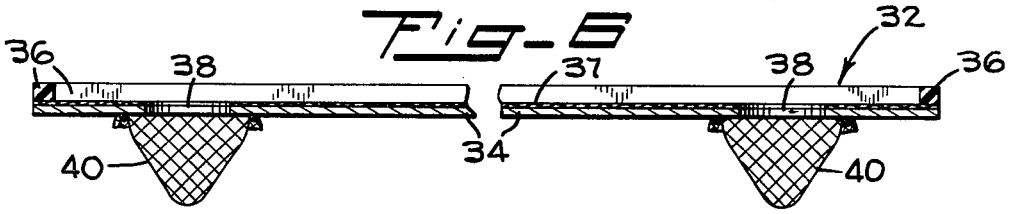
FIG. 6 is a section taken along line 6—6 of FIG. 5.

The reference numeral 32 of FIG. 2 indicates the insert or alternate board which is arranged to be placed over the basic board 12 to change the playing surface. This alternate board comprises a rigid base 34 (FIG. 6) having four side rails 36 and a felt cloth 37 secured to the base. Indicia is imprinted on the felt that is identical to the indicia inscribed in the surface of board 12. Four holes 38 extend through the base and through the felt, the holes being spaced from each other and from the center of the base 34 to conform to the spacing of the holes 13 in the main board 12. The board 32 is square in configuration and is of a size to fit snugly inside the four side rails 16–19 of the basic unit 10. When the board 32 is in position over the board 12, the holes 38 in board 32 overlie the holes 13 in board 12, and plastic mesh pockets 40 (FIG. 6), which are secured to the underside of the base 34 under the holes 38, extend down through the holes 13 as seen in FIG. 7.

It will be noted that the holes 38 are smaller in diameter than the holes 13 so that an overhanging annular ledge 42 is provided. When the alternate board 32 is to be removed from the main unit, the board 32 may be lifted by using the ledges 42 of two holes as lifting members.

The tripod stand 11 comprises three legs 45, each of which is generally rectangular in cross-section. Each leg has a lower slanted surface 46 and an upper slanted surface 47. Anti-slip pads 50 are pivotally mounted, as by conventional ball and socket joints, on the lower ends of studs 51, each of which is secured in the lower end of one of the legs along the longitudinal axis of the leg. Accordingly, when the pads 50 are placed on a support surface, such as a floor, they will assume flat positions on the floor with the legs 45 extending upwardly at an angle.

Figure 9:
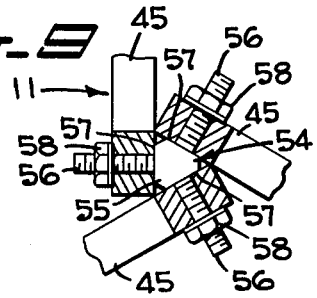
FIG. 9 is an enlarged plan view of the connector unit used to hold the legs of the tripod of FIG. 7 in fixed position.
Figure 8:
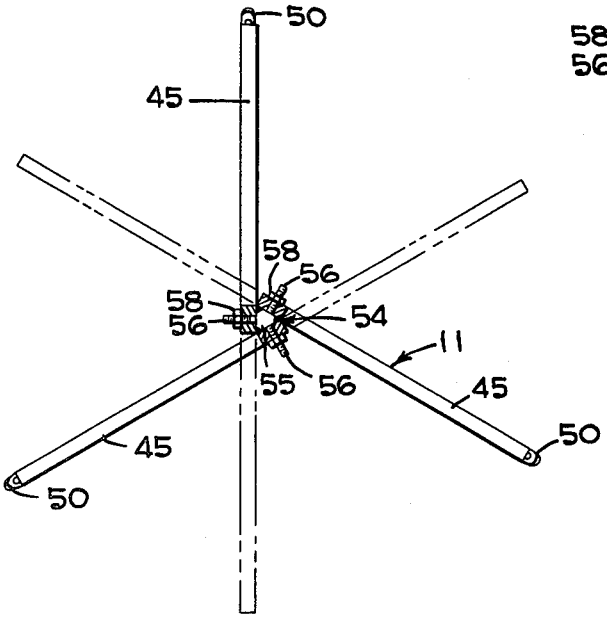
FIG. 8 is a horizontal section taken along line 8—8 of FIG. 1 of the tripod stand of the present invention.
Figure 10:
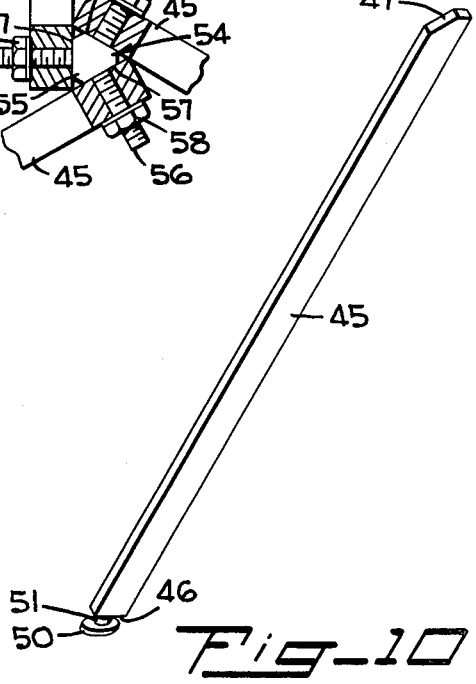
FIG. 10 is a perspective of one of the legs of the tripod.

The three legs are held together to form the tripod by a connector 54 which includes a central body portion 55 and three threaded studs 56 which are spaced in an angular direction around the center of the body 55 at 120 degree intervals. Adjacent the base of each stud 56, the body member 55 has a flat surface 57 which is at right angles to the axis of the stud and provides an abutment against which the side surface of one of the legs will rest when a washer and nut combination 58 is threaded on the stud, as seen in FIG. 9. The manner in which the three legs are jointed together by the connector 54 to form a tripod will be evident from FIG. 8. Also, it will be understood that, as diagrammatically indicated in FIG. 1, when the legs are locked together on the connector, their upper surfaces 47 are disposed in a generally horizontal plane to provide a level support for the game table 10.

From the foregoing description, it will be apparent that the present invention provides a simple, effective tripod stand and a game table that can be quickly and easily changed from one on which a particular game is played using wooden pucks on a hard veneer surface to one on which the same game can be played using plastic balls on a felt surface. The basic table is so constructed that the alternate playing surface can be quickly and accurately positioned on the basic table and easily removed therefrom.

While the preferred embodiment of the invention has been disclosed, modification and variations may be made without departing from the principles of the invention.

We claim:

1. A game table comprising a basic board having a first playing surface with apertures and indicia for playing a particular game, and an alternate board positionable over said basic board and having a second playing surface with indicia and apertures for playing the same game, said second playing surface having material characteristics different in texture from the material characteristics of said first playing surface.

2. A game table comprising a basic board having a first playing surface with apertures and indicia for playing a particular game, said first playing surface being a hard smooth surface, and an alternate board positionable over said basic board and having a second playing surface with indicia and apertures for playing the game, said second surface having physical characteristics different from the physical characteristics of said first playing surface, said second surface being provided by a felt cloth.

3. A game table comprising a basic board having a first playing surface with apertures therein and indicia thereon for playing a particular game, an alternate board positionable over said basic board and having a second surface with apertures therein and indicia thereon, said second surface having material characteristics different in texture from the material characteristics of said first playing surface, and means for aligning the apertures of said alternate board with the apertures of said basic board when said alternate board is positioned over said basic board.

4. A game table according to claim 3 including means defining a receptacle below each aperture in said basic board.

5. A game table according to claim 3 wherein said basic board and said alternate board are square in configuration and wherein said aperture aligning means is a wall extending around the playing surface of said basic board and projecting upwardly therefrom for engaging and confining said alternate board, said wall having portions on opposite sides of said square basic board extending below the playing surface of said basic board, and means defining a receptacle below each aperture in said basic board for receiving objects dropping therethrough, said receptacles respectively being open at one side to provide access thereto.

6. A game table as claimed in claim 4 and comprising pocket means defining a receptacle below each aperture in said alternate board to receive an object dropping therein, each of said pocket means being disposed within the associated means defining a receptacle below each aperture in said basic board when said alternate board is positioned over said basic board.

7. A game table as claimed in claim 5 and comprising pocket means defining a receptacle below each aperture in said alternate board to receive an object dropping therein, each of said pocket means being disposed within the associated means defining a receptacle below each aperture in said basic board when said alternate board is positioned over said basic board.

8. A game table comprising a basic board having a playing surface with apertures therein and indicia thereon for playing a particular game, an alternate board positionable over said basic board and having apertures therein and indicia thereon, means for aligning the apertures of said alternate board with the apertures of said basic board when said alternate board is positioned over said basic board, and means defining a receptacle depending from said alternate board directly below each aperture therein, each receptacle being proportioned to extend through an aperture in said basic board when said alternate board is placed over said basic board.

* * * * *